United States Patent [19]

Röder et al.

[11] 4,099,086

[45] Jul. 4, 1978

[54] APERTURE MASK UNIT FOR COLOR TELEVISION PICTURE TUBE

[75] Inventors: Dieter Röder; Heinz Tust, both of Neu-Ulm, Fed. Rep. of Germany

[73] Assignee: Licentia Patent-Verwaltungs-G.m.b.H., Frankfurt am Main, Fed. Rep. of Germany

[21] Appl. No.: 739,292

[22] Filed: Nov. 5, 1976

[30] Foreign Application Priority Data

Nov. 6, 1975 [DE] Fed. Rep. of Germany ..... 2549732

[51] Int. Cl.[2] ..... H01J 29/07; H01J 29/02

[52] U.S. Cl. ..... 313/407

[58] Field of Search ..... 313/405, 402, 404, 407, 313/403, 408, 406

[56] References Cited

U.S. PATENT DOCUMENTS

| | | | |
|---|---|---|---|
| 3,479,546 | 11/1969 | Mears | 313/404 |
| 3,581,135 | 5/1971 | Garrett et al. | 313/402 |
| 3,601,650 | 8/1971 | Pappadis | 313/407 X |
| 3,862,448 | 1/1975 | Ishizuka et al. | 313/402 |

FOREIGN PATENT DOCUMENTS

| | | | |
|---|---|---|---|
| 2,407,295 | 8/1974 | Fed. Rep. of Germany | 313/402 |
| 1,800,216 | 6/1970 | Fed. Rep. of Germany. | |
| 2,220,229 | 11/1972 | Fed. Rep. of Germany. | |
| 1,407,608 | 9/1975 | United Kingdom. | |

*Primary Examiner*—Robert Segal
*Attorney, Agent, or Firm*—Spencer & Kaye

[57] ABSTRACT

In a rectangular aperture mask unit for a color television picture tube composed of a thin metal sheet presenting a mask region of generally rectangular form and a peripheral flange surrounding the mask region and extending at an angle thereto, and a metal frame enclosed by the flange in a telescoping manner and fastened thereto by a plurality of spot welds distributed around the periphery of the flange, the flange is provided, at each corner of the unit, with two spaced cutouts extending from the edge of the flange remote from the mask region and defining a tongue which is curved in the direction of the periphery of the flange, the length of the cutouts being equal to at least one-half the height of the flange, and each tongue is fastened to the frame by at least one spot weld.

10 Claims, 4 Drawing Figures

APERTURE MASK UNIT FOR COLOR TELEVISION PICTURE TUBE

BACKGROUND OF THE INVENTION

The present invention relates to a rectangular shadow-mask, or aperture mask arrangement for a color television receiver cathode-ray tube, the arrangement including an aperture mask made of a thin metal sheet provided wih a peripheral flange, and a mask frame enclosed by the flange in a telescoping manner, the flange being fastened to the mask frame by means of a plurality of spot welds distributed around the periphery of the flange.

It is known that during operation of color television picture tubes, the impinging electron beams cause heating of the aperture mask, leading to expansion movements of the mask. Such movements can produce noticeable target errors and thus color impurities in the reproduced color picture.

Known aperture mask arrangements usually include the aperture mask proper, which is made of a very thin sheet of metal, e.g. steel, and which is provided with a peripheral flange, and a frame made of a thicker material which is inserted into the flange in a telescoping manner and which is fastened to the flange by spot welds.

SUMMARY OF THE INVENTION

It is an object of the present invention to provide an improved arrangement of the above-mentioned type which permits a reduction in the number of fastening points between the mask and the frame without significantly reducing the stability of the entire arrangement.

This and other objects according to the invention are achieved by providing the flange of such an aperture mask at each corner with cutouts defining a tongue which is slightly stiffened by the curvature of the corner, each tongue being formed by two cutouts of a length which is at least one-half of the height of the flange 4, and fastening each tongue to the mask frame by at least one spot weld.

This design of the corner regions of the flange of an aperture mask according to the invention makes it possible to provide at least one spot weld in each corner region without thus causing expansion movements experienced by the mask when it is heated to result in annoying color impurities. Moreover, the design of the mask arrangement according to the invention has the advantage that the mask will be less damaged by slight impacts which often occur during manufacture of the color picture tube by personnel handling the tube, so that the number of rejects is significantly reduced.

DESCRIPTION OF THE PREFERRED EMBODIMENTS

Figure 1:
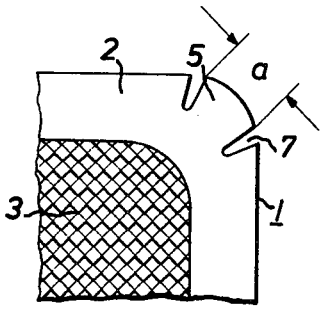
FIG. 1 is a plan detail view of one corner of one embodiment of an aperture mask according to the invention for use in a cathode-ray tube having a rectangular screen.

FIG. 1 is a top view of the corner of a metal sheet constituting an aperture mask 1 whose central region 3 is provided with apertures in a known manner. This central aperture region 3 is enclosed by an imperforate border region 2 which is generally coplanar with region 3. At the periphery of border region 2, the sheet is bent downwardly to present a peripheral flange not visible in FIG. 1.

According to the invention, the border region is provided at each corner of the mask 1 with cutouts 7 defining a tongue 5 which has a width *a* of 7 to 35 mm, and preferably 10 to 25 mm. A particularly preferred width value is 15 mm. The cutouts and tongue continue into the flange.

Figure 2:
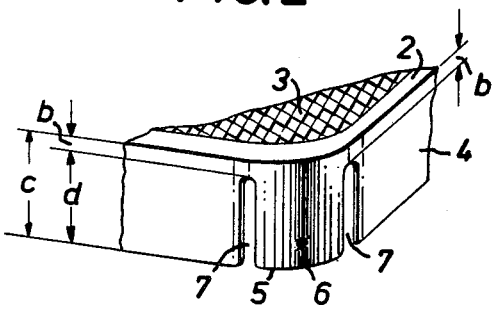
FIG. 2 is a perspective detail view of one corner of another embodiment of a mask according to the invention for a cathode-ray tube with a rectangular screen.

FIG. 2 is a perspective view of a corner of another aperture mask according to the invention. Again there is a central aperture region 3 and a surrounding border region 2. Here the two cutouts 7 at each corner are confined to the flange 4, as is the resulting tongue 5 which is slightly curved, and thus stiffened, in the peripheral direction. Again tongue 5 has a width of 7 to 35 mm, preferably 10 to 25 mm, and particularly about 15 mm. The height *d* of cutouts 7 in any case must be greater than one-half the depth, or height, *c* of flange 4.

The length *d* of each cutout 7 may be between 1 and 8 mm less than the height *c* of flange 4, and preferably between 1 and 6 mm less than height *c*. In one exemplary preferred form of construction, the length of the cutouts 7 is such as to leave a portion *b* of about 3 mm of the flange above tongue 5. In a television tube with a screen of 66 cm diagonal size a mask with a sheet thickness of about 0,15 mm and height *c* of the flange of about 13 mm was preferred used.

Portion *b* together with length *d* of cutouts 7 constitutes the depth, or height, *c* of flange 4. In the embodiment shown in FIG. 1 the cutouts 7 are extended into edge region 2.

Figure 3:
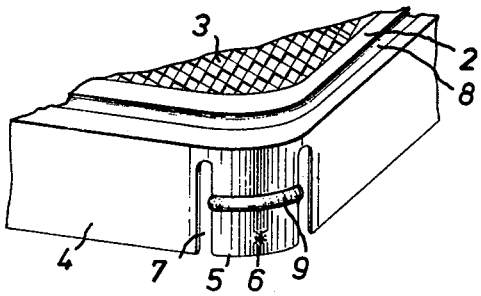
FIG. 3 is a view similar to that of FIG. 2 of a further embodiment of a mask according to the invention.

FIG. 3 shows a further preferred embodiment in which a recess, or corrugation, 8 is provided in border region 2 to serve as a stiffening reinforcement. This recess 8 extends around the entire periphery of the mask. Again a tongue 5 is formed at each corner by cutouts 7 and is fastened to the perforated mask frame by a spot weld 6.

According to a further modification of the invention, a further recess, or corrugation, 9 is provided in tongue 5 and also extends in the peripheral direction of the mask to provide a certain hinge effect. The spot weld 6 is disposed below this corrugation 9.

Figure 4:
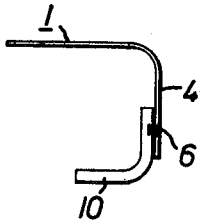
FIG. 4 is a simplified, pictorial, elevational view illustrating the arrangement of a mask and frame according to the invention.

FIG. 4 is a purely schematic view of an aperture mask 1 together with a frame 10 of thicker material. The bent flange 4 of the mask 1 is fastened to one leg of frame 10, which has an L-shaped cross section, by means of spot welds 6. A total number of about 10 spot welds may be provided with a mask of 59 cm diagonal size, one at each tongue 5 and the others at the flange 4 between the tongues 5.

It will be understood that the above description of the present invention is susceptible to various modifications, changes and adaptations, and the same are intended to be comprehended within the meaning and range of equivalents of the appended claims.

What is claimed is:

1. In a rectangular aperture mask structure for a color television picture tube composed of a thin metal sheet presenting a mask region of generally rectangular form and a peripheral flange surrounding the mask region and extending at an angle thereto, and a metal frame enclosed by the flange in a telescoping manner and fastened thereto by a plurality of spot welds distributed around the periphery of the flange, the flange being provided, at each corner of the structure, with two spaced cutouts extending from the edge of the flange remote from the mask region and defining a tongue which is curved, and thus stiffened, in the direction of the periphery of the flange, the length of the cutouts being equal to at least one-half the height of the flange, and each tongue being fastened to the frame by at least one spot weld, the improvement wherein said mask region includes a central aperture region and an imperforate border region extending around the periphery of said aperture region and disposed between said aperture region and said flange and said border region is provided with a continuous, peripherally extending recess.

2. An arrangement as defined in claim 1 wherein the width of each said tongue, in the direction of the periphery of said flange, is between 7 and 35 mm.

3. An arrangement as defined in claim 2 wherein said width is between 10 and 25 mm.

4. An arrangement as defined in claim 3 wherein said width is about 15 mm.

5. An arrangement as defined in claim 1 wherein said cutouts and said tongue extend into said border region.

6. An arrangement as defined in claim 1 wherein the length of each said cutout is between 1 mm and 8 mm less than the height of said flange.

7. An arrangement as defined in claim 6 wherein the length of each said cutout is between 1 mm and 6 mm less than the height of said flange.

8. An arrangement as defined in claim 7 wherein the length of each said cutout is about 3 mm less than the height of said flange.

9. An arrangement as defined in claim 1 wherein each said tongue is provided with at least one recess extending in the peripheral direction of said structure.

10. An arrangement as defined in claim 9 wherein the spot weld of each said tongue is disposed to the side of said recess remote from said mask region.

* * * * *